US006853263B2

(12) United States Patent
Brown et al.

(10) Patent No.: US 6,853,263 B2
(45) Date of Patent: Feb. 8, 2005

(54) CIRCULATORS AND ISOLATORS WITH VARIABLE FERROMAGNETIC FLUID VOLUMES FOR SELECTABLE OPERATING REGIONS

(75) Inventors: Stephen B. Brown, Palm Bay, FL (US); James J. Rawnick, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 125 days.

(21) Appl. No.: 10/421,400

(22) Filed: Apr. 23, 2003

(65) Prior Publication Data

US 2004/0263274 A1 Dec. 30, 2004

(51) Int. Cl.[7] ..... H01P 1/39
(52) U.S. Cl. ..... 333/1.1; 333/24.2
(58) Field of Search ..... 333/1.1, 24.2

(56) References Cited

U.S. PATENT DOCUMENTS 4,771,252 A * 9/1988 Morz et al. ..... 333/1.1
4,794,352 A * 12/1988 Morz et al. ..... 333/1.1

OTHER PUBLICATIONS

Wolfgang Borschel, "*Circulators and Ring Hybrids*", VHF Communications, Mar. 2000, pp. 179–185.

U.S. Appl. No. 10/330,761, filed Dec. 27, 2002, Brown et al.

U.S. Appl. No. 10/421,050, filed Apr. 23, 2003, Brown et al.

* cited by examiner

*Primary Examiner*—Stephen E. Jones
(74) *Attorney, Agent, or Firm*—Sacco & Associates, PA

(57) ABSTRACT

A circulator (100) is comprised of a transmission line three port Y junction (104). At least one substantially cylindrical cavity structure (113, 115 or 117) having a plurality of chambers is disposed adjacent to the Y junction and contains a ferromagnetic fluid (114). One or more magnets (112) are provided for applying a magnetic field (118) to the ferromagnetic fluid and the Y junction in a direction normal to a plane defined by said Y junction. A composition processor (301) is provided for changing a volume of ferromagnetic fluid in at least one among the plurality of chambers in response to a control signal to selectively alter the operating regions of the circulator.

21 Claims, 4 Drawing Sheets

CIRCULATORS AND ISOLATORS WITH VARIABLE FERROMAGNETIC FLUID VOLUMES FOR SELECTABLE OPERATING REGIONS

BACKGROUND OF THE INVENTION

1. Statement of the Technical Field

The present invention relates to the field of circulators and isolators, and more particularly to circulators and isolators that have variable RF properties.

2. Description of the Related Art

Circulators and isolators are devices that typically have three or more ports arranged in a ring and which provide unique RF transmission paths. An isolator is a three port circulator in which the third one of the ports has been terminated. Accordingly, for convenience, references to circulators herein shall be understood to also include isolators. Each type of device provides one way sequential transmission of power between its ports. For example, power in at port 1 couples only to port 2 with the exclusion of all other ports. More particularly, circulators and isolators are designed to allow RF energy to pass from a first port to a second port in a forward direction with little or no insertion loss, but present a high degree of attenuation for RF energy passing in a reversed direction from the second port to the first port. Similarly, RF energy is allowed to pass from the second port to a third port with low insertion loss, but is highly attenuated in the direction from the third port to the second port.

Circulators are often used to allow a receiver and a transmitter to share a common antenna by connecting a transmitter to port 1, an antenna to port 2 and a receiver to port 3. This arrangement provides for concurrent transmission and reception of signals. The antenna is always connected to the receiver and the transmitter but the receiver is isolated from the transmitted signals.

Most commonly, the fabrication of a circulator generally involves a three port Y junction of either rectangular waveguides or stripline that is loaded with ferrite cylinders or discs that are magnetized in a direction normal to the plane of the junction. Notably, while most circulators use a fixed direction of magnetic field and circulation, it is known in the art that the direction of circulation can be reversed by reversing the direction of the biasing magnetic field. This feature can be used to affect RF switching.

The ferrite discs used in circulators and isolators are typically formed from an iron powder that has been treated to produce an oxide layer on the outer surface. This oxide layer effectively insulates each iron particle from the next. The powder is mixed with a (non magnetic) ceramic bonding material and heated to form a rigid ceramic disc. Most common ferrite contains about 50% iron oxide. The remainder is typically either an oxide of manganese (Mn) and zinc (Zn) or nickel and zinc. Other types of ferrites can also be used to form the disc.

The operating frequency of circulators and isolators is primarily determined by the ferrimagnetic resonance frequency of the ferrite disk. The frequency of ferrimagnetic resonance can be affected by several factors including the diameter, permeability, and dielectric constant or permittivity of the ferrite disk. Maximum coupling of the energy from the RF signal to the ferrite material will occur at ferrimagnetic resonance. Accordingly, for reasons of efficiency, circulators and isolators are generally designed to operate either below ferrimagnetic resonance or above ferrimagnetic resonance. The operating frequency for below resonance (B/R) circulators are generally limited to the range from about 500 MHz to more than 30 GHz. By comparison, the practical range of operating frequencies for above resonance (A/R) circulators is lower, namely from about 50 MHz to approximately 2.5 GHz. From the foregoing, it may be observed that it can be difficult to design a single circulator capable of operating over a broad range of frequencies substantially below 500 MHz and more than 2.5 GHz.

Ferromagnetic materials (e.g. iron, nickel, cobalt, and various alloys) have atomic or molecular or crystalline magnetic dipole moments that exhibit a paramagnetic (i.e. positive feedback) response to magnetic fields. These dipole moments tend to align with the magnetic field but the alignment is disrupted by thermal motion of the atoms or molecules. In ferromagnetic materials, it is energetically favorable for all the dipole moments to be aligned. In at least some ferromagnetic materials, the field produced by the aligned dipoles is sufficient to maintain the alignment below the Curie temperature, thereby resulting in permanent magnets.

In ferrimagnetic materials, sometimes called ferrites, it is energetically favorable for neighboring dipole moments to be antiparallel but different types of atoms are present and the dipole moments do not cancel exactly. There can thus be a net positive dipole moment. Ferrimagnetic materials spontaneously subdivide into domains, small regions where all dipoles are parallel. The division into domains is such that total energy in the domain boundaries and fields is minimized. Arrangement of domains can be manipulated by externally applied electrical fields. It also influences the magnetic response of the material. These two properties are extremely useful in certain applications.

SUMMARY OF THE INVENTION

The invention concerns a circulator in which the operating region or other characteristics can be selectively altered so as to be above or below ferrimagnetic resonance. The circulator is comprised of a transmission line port junction such as a three port Y junction. At least one, and preferably more, substantially cylindrical cavity structures are disposed adjacent to the junction and contain a ferromagnetic fluid. Each substantially cylindrical cavity structure can include a plurality of chambers. One or more magnets are provided for applying a magnetic field to the ferromagnetic fluid and the junction in a direction normal to a plane defined by the junction. A processor is provided for changing a volume of the ferromagnetic fluid from at least one of the plurality of chambers in response to a control signal to alter the characteristics of the circulator. For example, the processor can vary the number of chambers containing the ferromagnetic fluid.

The cavity containing the ferromagnetic fluid has a ferrimagnetic resonance, and the change of the volume or shape of the ferromagnetic fluid causes a change in the ferrimagnetic resonance. By changing the ferrimagnetic resonance, an operating region of the circulator can be selected to be either above ferrimagnetic resonance or below ferrimagnetic resonance. More particularly, the change in volume and/or shape of the ferromagnetic fluid causes a change in the operating region. According to one aspect of the invention, a plurality of chambers in the form of a plurality of concentric tubes are filled or emptied responsive to the control signal to form the ferromagnetic fluid within the substantially cylindrical cavity structure or structures. The ferromagnetic fluid can be selected from the group consisting of a low permittivity, low permeability fluid, a high permittivity, low permeability fluid, and a high permittivity, high permeability fluid.

According to another aspect, the ferromagnetic fluid can be comprised of an industrial solvent and a suspension of magnetic particles contained therein. The magnetic particles can be formed of a material selected from the group consisting of ferrite, metallic salts, and organo-metallic particles and the ferromagnetic fluid can comprise between about 50% to 90% of the magnetic particles by weight.

DETAILED DESCRIPTION OF THE INVENTION

Figure 1:
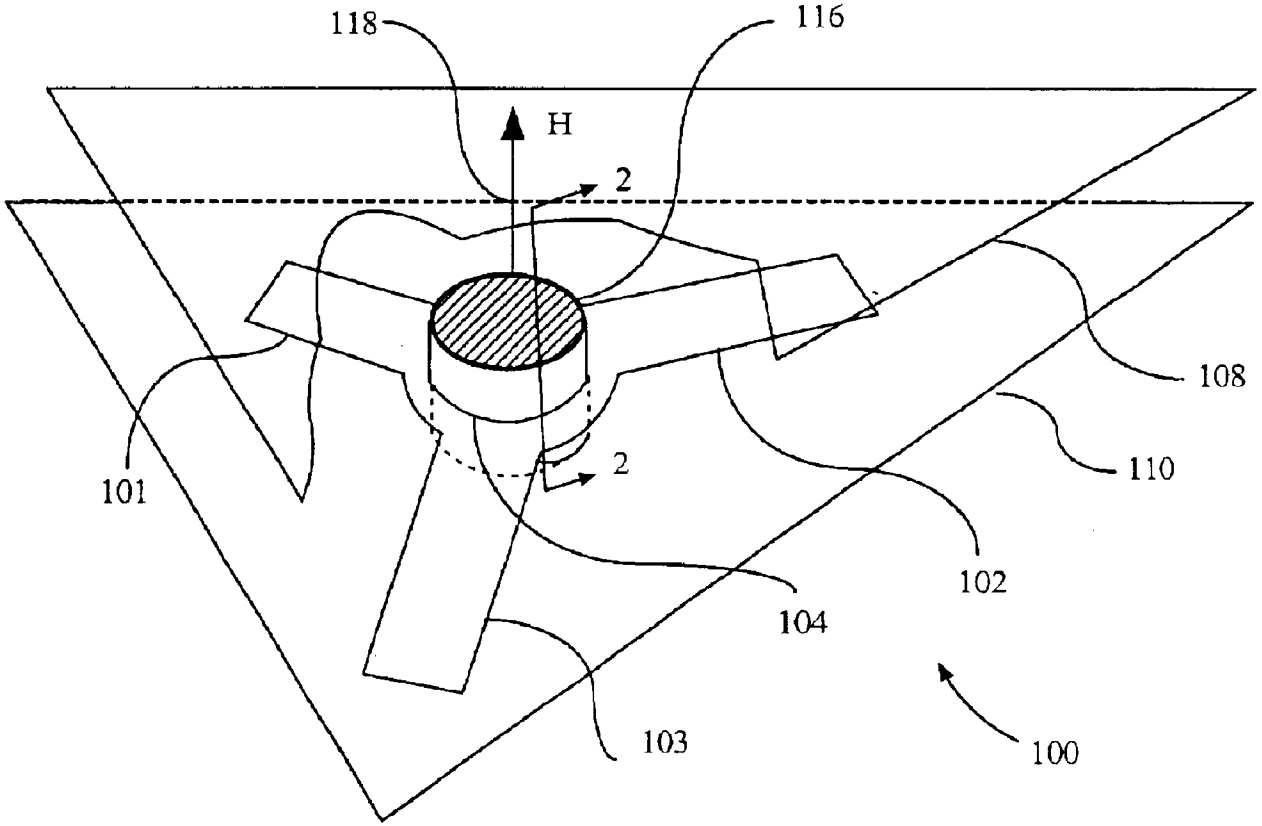
FIG. 1 is a perspective view of a circulator that is useful for understanding the invention.

FIG. 1 is a perspective view of a circulator 100 that is useful for understanding the invention. For convenience, the term circulator as used herein should also be understood to also include isolators, which are really a special case of a circulator. As illustrated in FIG. 1, the circulator is comprised of metal case 116 and three transmission line ports 101, 102, 103 that are terminated in a junction 104, in particular a Y junction in this instance. Electric ground planes 108, 110 are shown above and below the transmission line ports 101, 102, and 103.

Figure 2:
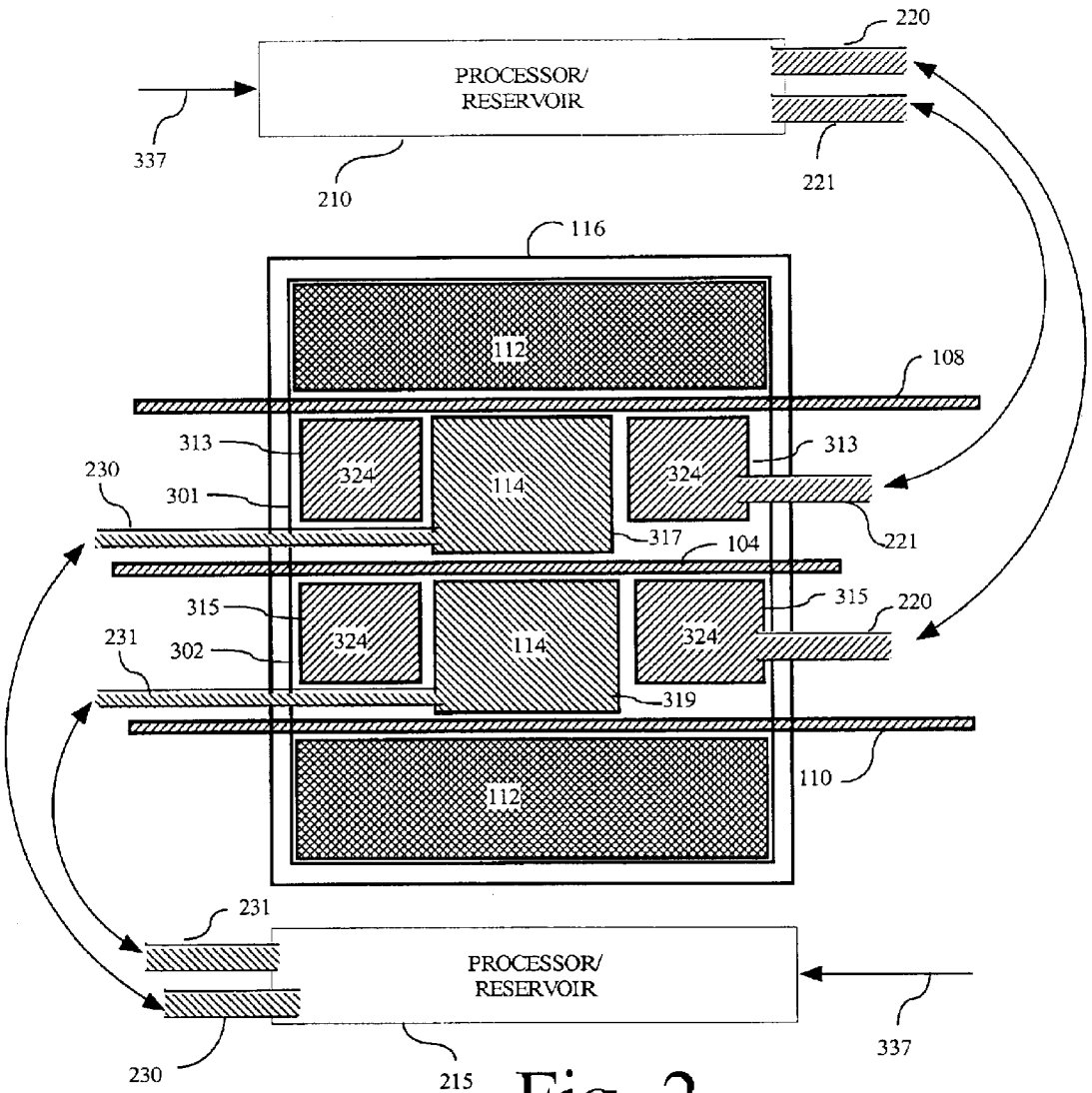
FIG. 2 is a cross-sectional view of the circulator of FIG. 1, taken along lines 2—2.

Referring now to FIG. 2 in a cross-sectional view across line 2—2, it can be seen that the circulator includes several components within the metal case 116. In conventional circulators, ferrite discs are positioned in the area between the transmission line Y junction 104 and the electric ground planes 108, 110. In the present invention, however, the ferrite discs are preferably eliminated in favor of ferromagnetic fluid 114 and 324 that is contained within substantially cylindrical cavity structures 301, 302. More particularly, fluid 114 can be contained within chambers 317 and 319 and fluid 324 can be contained within chambers 313 and 315 of substantially cylindrical cavity structures 301 and 302 respectively. Magnets 112 are preferably provided above and below electric ground planes 108 and 110, respectively. These can be either permanent magnets or electromagnets. The metal case 116 is preferably formed of steel or aluminum with steel cladding to provide a magnetic return circuit. The volumes of ferromagnetic fluid in each of the substantially cylindrical cavity structures 301,302 can be manipulated using at least one processor and/or reservoir. As shown in FIG. 2, the volume of ferromagnetic fluid in chambers 317 and 319 is controlled by processor 210 whereas the volume of ferromagnetic fluid in chambers 313 and 315 is controlled by processor 215. Fluid is pumped in and out of chamber 315 via conduit 220 and in and out of chamber 313 via conduit 221. Conduits 220 and 221 help recirculate ferromagnetic fluid through the processor 210. Likewise, fluid is pumped in and out of chamber 317 via conduit 230 and in and out of chamber 319 via conduit 231. Conduits 230 and 231 help recirculate ferromagnetic fluid back through processor 215. Valves (not shown) can also be used to provide further control in the communication of fluid between processors and cavities or chambers. A particular volume of a specified ferromagnetic fluid can be used to change the ferrimagnetic resonance of the circulator which enables the selection of an operating region of the circulator to be either above ferrimagnetic resonance or below ferrimagnetic resonance.

A fluid suspension of ferromagnetic particles can behave ferrimagnetically, with the suspended particles acting the role of domains. In such cases, it will be energetically favorable for the particles to pair up in antiparallel sets (this can be visualized as particle sized bar magnets in suspension.) The exact response of the ferromagnetic fluid will depend on the shape and size distribution of the particles. For example, disk shaped particles will behave differently as compared to bar magnets. Significantly, however, the ferromagnetic fluid can be selected to have a ferrimagnetic resonance that is similar to the conventional type ferrite disks that are presently used in circulators and isolators.

In the absence of a magnetic field, an RF signal applied at a transmission line port 101 (of circulator 100 of FIG. 1) will be transferred equally to ports 102 and 103, provided that all of the transmission lines are equally spaced from one another. This power transfer is due to a pattern of standing waves that are established relative to the input transmission line port 101. These standing waves are symmetrical relative to the input transmission line port 101. However, when an axial magnetic field 118 is applied to the ferromagnetic fluids 114 and 324 in cavity structures 301, 302, the presence of such axial magnetic field alters the symmetrical pattern of standing waves.

As is known from conventional circulator design, the desired characteristics of circulation and isolation are obtained by causing the standing wave pattern to rotate approximately 30 degrees. With the magnetic field oriented in a first axial direction, it will produce a null at transmission line port 102, making it the isolation port. The shift in standing wave pattern also causes transmission line port 103 to be fully coupled to the input port 101. Those skilled in the art will appreciate that the invention is not limited to one particular direction of circulation. Rather, a direction of circulation, and the coupling or isolation of the ports, will be determined by the axial direction of the magnetic field. Reversing the direction of the magnetic field reverses the direction of circulation.

The operational frequency of the circulator will be determined substantially by the ferrimagnetic resonance frequency of the ferromagnetic fluid 114 and 324 contained in cylindrical cavity structures 301 and 302. The ferrimagnetic resonance frequency can be selected by controlling one or more of several design parameters, including the cavity diameter, permeability, and dielectric constant or permittivity of the "ferrite disk". In general, for A/R operation the ferromagnetic fluid will need to have a higher effective permeability as compared to the permeability required for B/R operation. According to a preferred embodiment of the invention, the permeability and dielectric constant of the ferromagnetic fluid can be dynamically controlled to select the ferrimagnetic resonance frequency and thereby obtain efficient circulator operation over a range of RF frequencies not otherwise obtainable. Note that although the cavity structure 301 is formed by concentric chambers 317 and 313 and the cavity structure 302 is formed by concentric chambers 319 and 315, the cavity structures 301 and 302 are not limited to such arrangement. Such cavity structures can have more concentric rings or other concentric shapes or other non-concentric chambers defining the cavity structures without departing from the scope of the present invention. Note also that the composition of the fluids 114 and 324 can be the same or be made to have different permeability, permittivity or other characteristics.

For example, in another embodiment, a circulator 300 can include a processor 350 and at least one substantially cylindrical cavity structure 375 having a plurality of concentric chambers 360. The plurality of concentric chambers 360 can be formed from a plurality of concentric capillary tubes. Ferromagnetic fluid can be fed or withdrawn from each of the concentric chambers 360 via conduit feeds 370 coupled between the processor 350 and respective concentric chambers 360. The processor 350 can also include a reservoir for storage or removal of ferromagnetic fluid as required. Other portions of the circulator such as the magnetic sources and other chambers discussed in the prior embodiment are not shown for simplicity.

It is known that circulators and isolators are generally designed to operate either below ferrimagnetic resonance or above ferrimagnetic resonance. The operating frequency for below resonance (B/R) circulators are generally limited to the range from about 500 MHz to more than 30 GHz. By comparison, the practical range of operating frequencies for above resonance (A/R) circulators is lower, namely from about 50 MHz to approximately 2.5 GHz. At high frequencies, the A/R circulator requires a very high intensity magnetic field to operate efficiently. Therefore, in order to obtain efficient operation of a circulator over a range of frequencies that extend substantially below about 500 MHz and substantially above about 2.5 GHz, it can be advantageous to selectively control the characteristics of the ferromagnetic fluid contained in the cylindrical cavity structures 301, 302. This will allow the ferromagnetic resonance frequency to be dynamically changed. Consequently, the circulator can be configured to operate above ferrimagnetic resonance for lower operating frequencies, and below ferrimagnetic resonance when the device is used for higher operating frequencies.

In addition to allowing control over the ferrimagnetic resonance frequency, dynamic control over the permeability and permittivity of the ferromagnetic fluid can also permit the impedance of the ferromagnetic fluid contained in the cylindrical cavity structures to be adjusted for an improved match at different frequencies of operation. This ability to adjust impedance can help to reduce the need for external transformer sections as are commonly required for broad bandwidth circulator applications.

Composition of Ferromagnetic Fluid

The ferromagnetic fluid as described herein can be comprised of several component parts that can be mixed together to produce a desired permeability and permittivity required for a particular ferromagnetic resonance and Y junction impedance. The mixture preferably has a relatively low loss tangent to minimize the amount of RF energy that is lost. The component parts can be selected to include a first fluid made of a high permittivity solvent completely miscible with a second fluid made of a low permittivity oil. A third fluid component can be comprised a ferrite particle suspension in a low permittivity oil identical to the first fluid such that the first and second fluids do not form azeotropes.

A nominal value of relative permittivity ($\epsilon_1$) for fluids is approximately 2.0. However, a mixture of such component parts can be used to produce a wide range of permittivity values. For example, component fluids could be selected with permittivity values of approximately 2.0 and about 58 to produce a ferromagnetic fluid with a permittivity anywhere within that range after mixing. Dielectric particle suspensions can also be used to increase permittivity.

According to a preferred embodiment, the component parts of the ferromagnetic fluid can be selected to include a high permeability component. High levels of magnetic permeability are commonly observed in magnetic metals such as Fe and Co. For example, solid alloys of these materials can exhibit levels of $\mu_r$ in excess of one thousand. By comparison, the permeability of fluids is nominally about 1.0 and they generally do not exhibit high levels of permeability. However, high permeability can be achieved in a fluid by introducing magnetic particles/elements to the fluid. For example typical magnetic fluids comprise suspensions of iron, ferro-magnetic or ferrite particles in a conventional industrial solvent such as water, toluene, mineral oil, silicone, and so on. Other types of magnetic particles include metallic salts, organo-metallic compounds, and other derivatives, although Fe and Co particles are most common. The size of the magnetic particles found in such systems is known to vary to some extent. However, particles sizes in the range of 1 nm to 20 $\mu$m are common. The composition of particles can be varied as necessary to achieve the required range of permeability in the final mixed ferromagnetic fluid. However, magnetic fluid compositions are typically between about 50% to 90% particles by weight. Increasing the number of particles will generally increase the permeability.

Processing for Communicating Ferromagnetic Fluid Between Reservoirs, Cavities & Chambers A cooperating set of proportional valves, pumps (as may be included in the processor/reservoirs 210 and 215), and connecting conduits can be provided for selectively communicating the ferromagnetic fluids 114 and 324 from the fluid reservoirs to cylindrical cavity structures 301 and 302. The operation of the processor(s) shall now be described in greater detail with reference to FIG. 2 and the flowchart shown in FIG. 4.

Figure 4:
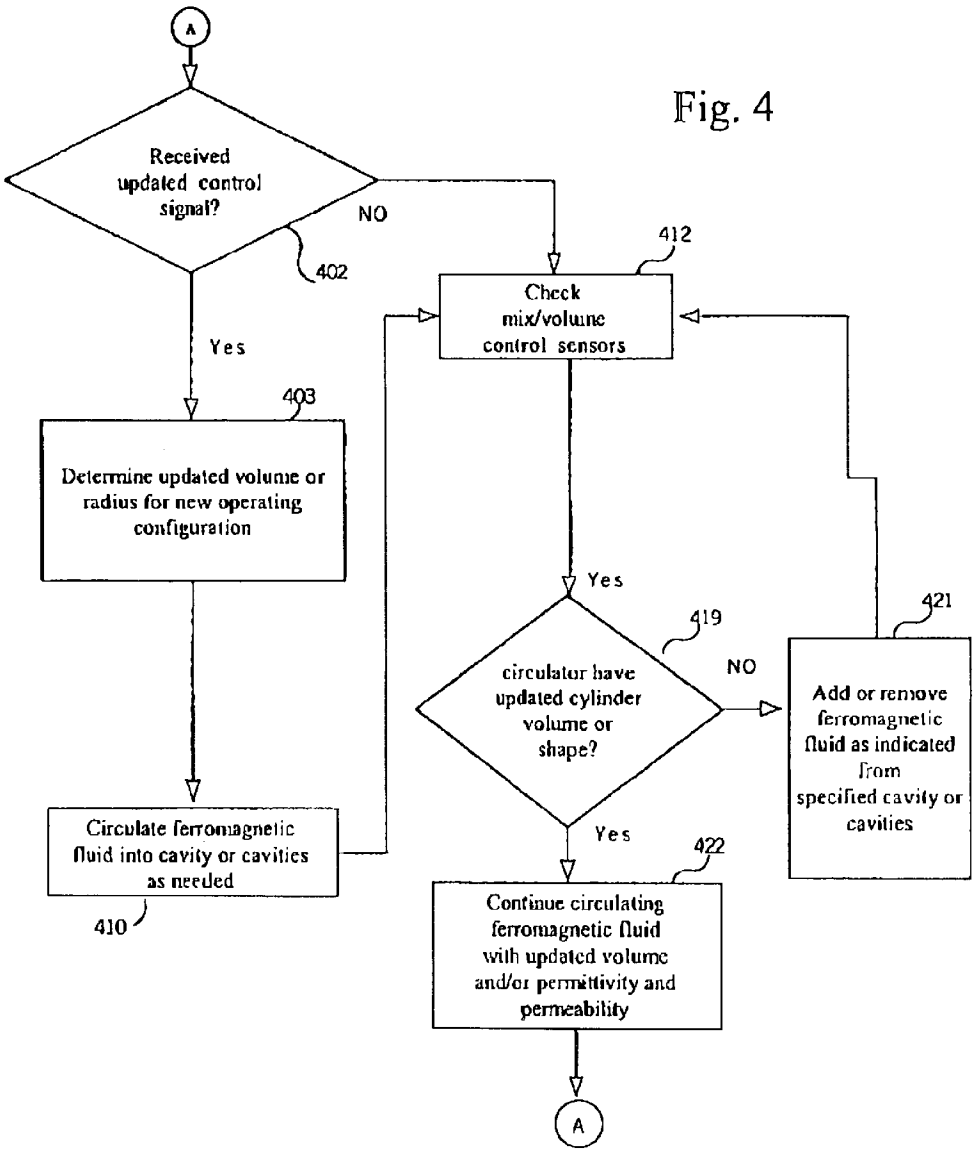
FIG. 4 is a flowchart illustrating a process that can be used for using ferromagnetic fluid in altering the operating characteristics of a circulator in accordance with the present invention.

The process can begin in step 402 of FIG. 4, with processor 210 and/or 214 checking to see if an updated configuration control signal has been received on a control signal input line 337. If so, then the processor (210 and/or 215) continues on to step 403 to determine an updated volume or radius for the new circulator configuration. The updated volume and/or radius necessary for achieving circulator operating parameters is preferably determined using a look-up table but can be calculated directly based on the specific operating configuration indicated by the control signal.

In step 410, the processor causes the ferromagnetic fluid 114 and/or 324 to be circulated into the respective cavities 301 and 302 defined by chambers 317, 319, 313 and 315. The ferromagnetic fluid can be communicated to the chambers and excess fluid can be re-circulated to the processor through the conduits. In step 412, the controller can check one or more sensors to determine if the ferromagnetic fluid being circulated to the cavity structures 313 and 315 has the proper values of volume and/or permeability and permittivity. The sensors can include inductive type sensors capable of measuring permeability, capacitive type sensors capable of measuring permittivity, as well as flowmeters.

In step 419, the processor can compare the measured volume (and or shape) to the desired updated cylinder volume value (or shape) determined at step 403. If the updated value does not match or meet a particular predefined range of values, then at step 421, the ferromagnetic fluid can be added or removed as indicated from predetermined chambers. If the volume and/or shape are the proper values and optionally the values for permittivity and permeability passing into and out of the cavities defined by cavity structures 301 and 302 are the proper value, then the system can stop circulating the ferromagnetic fluid and the system returns to step 402 to wait for the next updated control signal.

Significantly, when updated ferromagnetic fluid is required, any existing ferromagnetic fluid can be circulated out of the cavity structures 301 and 302. Any existing ferromagnetic fluid not having the proper permeability and/or permittivity can be deposited in a collection reservoir. The ferromagnetic fluid deposited in the collection reservoir can thereafter be re-used at a later time to provide additional ferromagnetic fluid as needed.

An example of a set of component parts that could be used to produce a ferromagnetic fluid as described herein would include oil (low permittivity, low permeability), a solvent (high permittivity, low permeability) and a magnetic fluid, such as combination of an oil and a ferrite (low permittivity and high permeability). A hydrocarbon dielectric oil such as Vacuum Pump Oil MSDS-12602 could be used to realize a low permittivity, low permeability fluid, low electrical loss fluid. A low permittivity, high permeability fluid may be realized by mixing the same hydrocarbon fluid with magnetic particles such as magnetite manufactured by FerroTec Corporation of Nashua, N.H., or iron-nickel metal powders manufactured by Lord Corporation of Cary, N.C. for use in ferrofluids and magnetoresrictive (MR) fluids. Additional ingredients such as surfactants may be included to promote uniform dispersion of the particle. Fluids containing electrically conductive magnetic particles require a mix ratio low enough to ensure that no electrical path can be created in the mixture.

Solvents such as formamide inherently posses a relatively high permittivty and therefore can be used as the high permittivity component of the ferromagnetic fluid for the invention. Permittivity of other types of fluid can also be increased by adding high permittivity powders such as barium titanate manufactured by Ferro Corporation of Cleveland, Ohio. For broadband applications, the fluids would not have significant resonances over the frequency band of interest.

Figure 3:
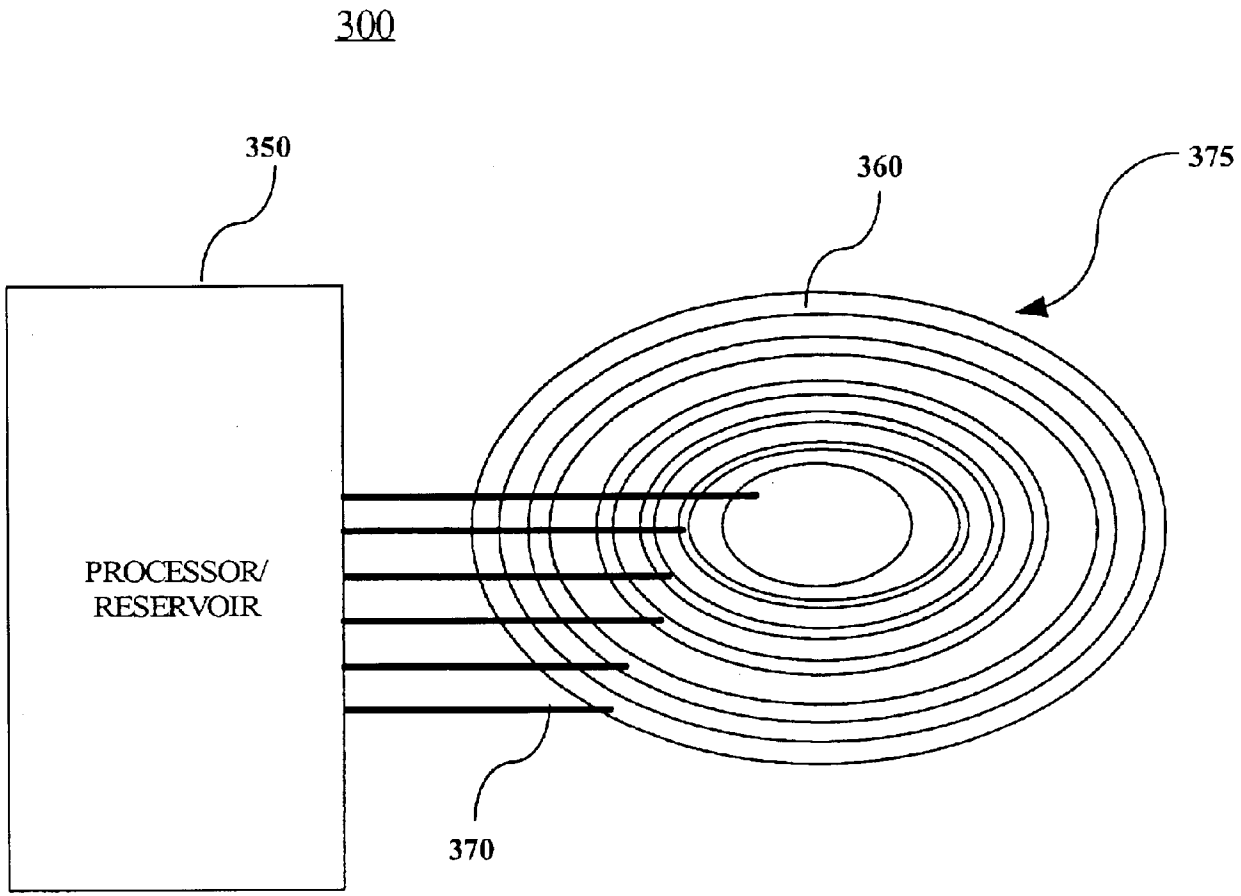
FIG. 3 is a schematic representation of a portion of a circulator including a processor for varying the volume of a ferromagnetic fluid in a substantially cylindrical cavity structure formed from a plurality of concentric tubes.

It should be noted that the present invention is not limited to the embodiments shown in FIG. 2 or 3. In particular, the circulator can be configured to have more than two substantially cylindrical cavity structures or more than two chambers in any particular cavity structure as shown in FIG. 3. The circulator is not limited to a particular number of ports (3 and 4 ports are common) or a particular number of processors as evidenced by the embodiments of FIGS. 2 and 3. Furthermore, the ferromagnetic fluids 114 and 324 do not necessarily need to have the same composition or characteristics. For example, ferromagnetic fluid in chamber 313 can have a different permeability and permittivity and/or volumes than the ferromagnetic fluid in chamber 315.

Those skilled in the art will also recognize that the specific process used to communicate, mix or to separate the component parts from one another will depend largely upon the properties of materials that are selected and the invention. Accordingly, the invention is not intended to be limited to the particular process or structure outlined above.

We claim:

1. A circulator, comprising:

a transmission line port junction;

at least one substantially cylindrical cavity structure disposed adjacent to said port junction, wherein the cavity structure further includes a plurality of chambers;

a processor for selectively adding and removing ferromagnetic fluid from at least one among the plurality of chambers in said at least one substantially cylindrical cavity; and at least one magnetic field applied to said ferromagnetic fluid when present and to said port junction, said magnetic field applied in a direction normal to a plane defined by said port junction.

2. The circulator according to claim 1, wherein the plurality of chambers comprise a plurality of concentric tubes consisting of quartz capillary tubes.

3. The circulator according to claim 1, wherein said ferromagnetic fluid contained within said cylindrical cavity structure has a ferrimagnetic resonance, and said selective adding and removing of said ferromagnetic fluid causes a change in said ferrimagnetic resonance.

4. The circulator according to claim 3, wherein said circulator has an operating region above ferrimagnetic resonance and below ferrimagnetic resonance, and said selective adding and removing of said ferromagnetic fluid causes a change in said operating region.

5. The circulator according to claim 1 wherein the circulator further comprises a ferrite core surrounded by the plurality of chambers formed in concentric fashion around the ferrite core.

6. The circulator according to claim 1 wherein said ferromagnetic fluid is selected from the group consisting of low permittivity, low permeability fluids, high permittivity, low permeability fluids, and high permittivity, high permeability fluids.

7. The circulator according to claim 1, wherein said processor further comprises at least one pump and at least one conduit for selectively communicating said ferromagnetic fluid to said at least one chamber among the plurality of chambers.

8. The circulator according to claim 1 wherein said ferromagnetic fluid is comprised of an industrial solvent.

9. The circulator according to claim 1 wherein at least one component of said ferromagnetic fluid is comprised of an industrial solvent that has a suspension of magnetic particles contained therein.

10. The circulator according to claim 9 wherein said magnetic particles are formed of a material selected from the group consisting of ferrite, metallic salts, and organometallic particles.

11. The circulator according to claim 10 wherein said component contains between about 50% to 90% of said magnetic particles by weight.

12. The circulator according to claim 1 wherein said ferromagnetic fluid is comprised of magnetic particles and hydrocarbon dielectric oil.

13. The circulator according to claim 12 wherein said magnetic particles are comprised of a metal selected from the group consisting of iron, nickel, manganese, and zinc.

14. The circulator according to claim 1, wherein the transmission line port junction is a three line port junction.

15. The circulator according to claim 1, wherein the transmission line port junction is a four line port junction.

16. A method for altering an operating characteristic of a circulator, comprising:

positioning at least one substantially cylindrical cavity structure having a plurality of chambers capable of receiving a ferromagnetic fluid adjacent to a transmission line junction;

magnetically biasing said ferromagnetic fluid when present and magnetically biasing said junction with a magnetic field applied in a direction normal to a plane defined by said junction; and changing a volume of said ferromagnetic fluid in at least one chamber among the plurality of chambers in response to a control signal to alter the operating characteristic of the circulator.

17. The method according to claim 16 further comprising the step of selectively changing said volume of said ferromagnetic fluid so as to cause a change in a ferrimagnetic resonance of said ferromagnetic fluid contained in said cylindrical cavity structure.

18. The method according to claim 16 further comprising the step of changing said volume of said ferromagnetic fluid so as to change an operating region of said circulator to at least one of above ferrimagnetic resonance and below ferrimagnetic resonance.

19. The method according to claim 16 further comprising the step of selectively changing said volume of said ferromagnetic fluid so as to cause a variation in a permittivity and a permeability of said circulator.

20. The method according to claim 16 further comprising the step of forming said ferromagnetic fluid as a mixture of an industrial solvent and a suspension of magnetic particles, wherein said magnetic particles are selected from the group consisting of ferrite, metallic salts, and organo-metallic particles.

21. The method according to claim 16 further comprising the step of selecting said ferromagnetic fluid to be comprised of magnetic particles and hydrocarbon dielectric oil, wherein said magnetic particles are selected from the group consisting of iron, nickel, manganese, and zinc.

* * * * *